United States Patent [19]

Brotzmann et al.

[11] 4,050,681

[45] Sept. 27, 1977

[54] APPARATUS FOR THE CONTROLLED FEEDING OF A REFINING GAS AND OF A FLUID PROTECTIVE MEDIUM

[75] Inventors: Karl Brotzmann; Hans Georg Fassbinder, both of Sulzbach-Rosenberg, Germany

[73] Assignee: Eisenwerk-Gesellschaft Maximilianshutte mbH, Sulzbach-Rosenberg, Germany

[21] Appl. No.: 468,967

[22] Filed: May 10, 1974

[30] Foreign Application Priority Data

May 25, 1973 Germany ..... 2326754

[51] Int. Cl.[2] ..... C21C 5/34

[52] U.S. Cl. ..... 266/82; 75/60; 266/223

[58] Field of Search ..... 75/60, 52–59; 266/35, 36 P, 41, 82, 223

[56] References Cited

U.S. PATENT DOCUMENTS

| | | | |
|---|---|---|---|
| 3,212,879 | 10/1965 | Cordier | 266/41 X |
| 3,343,826 | 9/1967 | Manny et al. | 266/41 X |
| 3,706,549 | 12/1972 | Knuppel et al. | 266/35 X |
| 3,796,420 | 3/1974 | Pearce | 266/35 |
| 3,801,305 | 4/1974 | Nilles et al. | 75/60 |
| 3,817,505 | 6/1974 | LeRoy et al. | 266/41 |
| 3,820,768 | 6/1974 | Sieckman et al. | 266/35 |
| 3,851,866 | 12/1974 | Knuppel et al. | 266/41 |
| 3,871,633 | 3/1975 | Kolb et al. | 266/35 |
| 3,895,785 | 7/1975 | Kolb et al. | 266/35 |
| 3,897,047 | 7/1975 | Kolb et al. | 266/35 |

FOREIGN PATENT DOCUMENTS

| | | | |
|---|---|---|---|
| 625,962 | 8/1961 | Canada | 266/20 |
| 2,017,694 | 4/1971 | Germany | 266/41 |

*Primary Examiner*—Roy Lake
*Assistant Examiner*—Paul A. Bell
*Attorney, Agent, or Firm*—Lawrence I. Field

[57] ABSTRACT

An improved apparatus for supplying the refining gas and protective media utilized in the refining process described in U.S. Pat. No. 3,706,549 issued Dec. 19, 1972, including valves provided in the supply lines for preventing malfunctioning of the process.

11 Claims, 3 Drawing Figures

APPARATUS FOR THE CONTROLLED FEEDING OF A REFINING GAS AND OF A FLUID PROTECTIVE MEDIUM

This invention relates to an apparatus for controlling the supply of a refining gas and of a fluid protective medium to tuyeres mounted in the refractory masonry of a refining vessel and consisting of at least two concentric pipes each of which is provided with its own supply line, the refining gas being passed through the center pipe and the protective medium through the annular space between the two pipes constituting each tuyere.

A refining process using pure oxygen and a protective medium blown into a refining vessel through dual tuyeres is described in U.S. Pat. No. 3,706,549 issued Dec. 19, 1972. It is possible, as regards this process, that the oxygen issuing from the center pipe of the tuyere may enter the annular space between the two pipes during refining, or vice versa, that the protective medium will pass from the annular space into the center pipe. As a consequence there is a danger, if use is made of pure oxygen as the refining gas and of a combustible protective medium such as hydrocarbons, for instance propane or oil, that undesired fires will occur, these being especially likely to occur at those locations where the separate supply lines to the annular spaces of the individual tuyeres branch off from the common main line. Because such fires interfere with operation, proposals have been made for the purpose of avoiding overflowing at the tuyeres. On the whole however, such proposals have failed to remedy the problems, and as of the present date, it has not been possible to completely prevent overflowing or back-flowing of the oxygen or of the protective media in dual or multiple-pipe tuyeres of the kind presently known in this art. This failure is particularly severe when the tuyere orifices are permanently sealed or temporarily deformed as a result of operating conditions, because pressure builds up in the region of the seal or of the narrowed cross-section and said pressure casues overflowing of one substance into the supply line of the other which is at a lower pressure.

In U.S. Pat. No. 3,706,549, the apparatus disclosed includes separate supply lines to the annular spaces located between the pipes, said supply lines serving to introduce the protective medium and being furthermore provided with back-pressure valves. Effectiveness of these back-pressure valves however is predicated on the oxygen pressure always appreciably exceeding that of the protective medium. It has been found in practice that this is not always the case, fluctuations in oxygen pressure do occur, especially when the oxygen is being loaded with lime dust and when there is a change in the amount of lime dust blown in during refining, or if there is refining without lime dust for a short interval. For instance, for a rate of feed of 5 kg of lime dust per cubic meter of oxygen (STP) the oxygen may be at 15 atmospheres gauge pressure, and may drop to about 6 atmospheres gauge during a short-term interval during which refining involves blowing without lime dust. In addition, there are inevitable pressure fluctuations in the supply system of the oxygen, and quite often oxygen pressure at the tuyere orifice will only be 3–4 atmospheres gauge. Such a pressure is quite close to the usual pressure of the protective hydrocarbon medium issuing from the annular space between the oxygen pipe and the protective medium pipe. Under these circumstances, and especially if the annular space becomes partly clogged, e.g. by metallic deposits, there may easily be back-flowing of the protective medium into the oxygen supply line and hence there may easily be a fire. Experience has shown that the formation of deposits at the tuyere orifice will proceed from the outside to the inside and that as a consequence the annular space will narrow, even though the orifice of the central pipe supplying the oxygen remains essentially unaffected. The varying degree of deposit formation from the orifices of one tuyere to another and the varying properties of the deposits, especially their differing porosities and flow resistances, will affect the flow rates of protective medium supplied from the main line to the individual tuyeres. Again, this may cause operational difficulties because the desired even wear of the tuyeres and of the surrounding masonry depends on as equal a distribution of the protective medium to the individual tuyeres as possible.

The present invention is directed to the task of remedying the previously mentioned difficulties and especially to prevent overflowing of the protective medium or of the oxygen into each other and furthermore to achieve as even as possible a distribution of the protective medium to the tuyeres. This problem is solved for the refining process of the kind described in U.S. Pat. No. 3,706,549 by providing each supply line for the protective medium with a control valve, a pressure-relief or pressure reducing valve controlled by the refining gas pressure and a back-pressure or non-return valve located behind said pressure reducing valve. By means of this arrangement, the pressure of the protective medium may be controlled for each tuyere as a function of the oxygen pressure in the main line feeding all the tuyeres or as a function of the oxygen pressure in the supply lines to the individual tuyeres or in the supply line to the particular tuyere. In order to take into account oxygen pressure fluctuations caused by varying loadings of lime dust, it is usually sufficient to control the pressure of the protective medium as a function of the oxygen pressure in the main line to all tuyeres.

The control valves may be adjusted all together, or all protective medium supply lines may be connected to a common control valve with a number of outlets corresponding to the number of tuyeres. The common valve will then provide the same flow cross-section to each supply line.

Preferably a shut-off valve is mounted in the direction of flow and ahead of the control valves. The pressure in the protective medium supply lines will always be less than that of the refining gas or oxygen. If there should be a change in the pressure conditions, for instance due to a tuyere being partly blocked and if oxygen were to penetrate the annular space for the protective medium, then the particular back-pressure valve would operate and prevent the oxygen at higher pressure from entering the supply system located behind the valve. If on the other hand pressure conditions should so change that oxygen pressure were to drop, then the pressure of the protective medium would also drop on account of the pressure-reducing valves and in such manner as to be always less than that of the refining gas. Therefore overflowing of the protective medium into the oxygen supply line is not possible. To that extent also it is no longer necessary to mount a back-pressure valve in the oxygen supply line, and this is an advantage because the wear of such back-pressure valves is very high when the refining is with oxygen carrying lime in suspension.

The pressure-reducing valves are preferably controlled in unison by a pressure transmitter mounted in the by-pass line of the main refining gas supply line. Preferably, when using common control of the pressure-reducing valves, an orifice plate is located upstream of the pressure transmitter and a shut-off valve and a back-pressure valve are located downstream. Furthermore, a shut-off valve and a control valve and a lime-supply meter with a metering valve may be mounted in the main refining gas supply line. In order to suppress as much as possible any kind of disturbances in the operation of the apparatus of the invention, the protective medium preferably is under full pressure as far as the common control valve or the control valves and is allowed to expand in the supercritical pressure ratio so that it will flow at the speed of sound in the free valve cross-section and so that varying pressure losses at the tuyere orifices will not affect the rate of the protective medium. In this instance, the flow rate of the protective medium will be solely determined by the free cross-section of the valve orifice.

The invention will be better understood from the description taken with the drawings in which.

Figure 1:
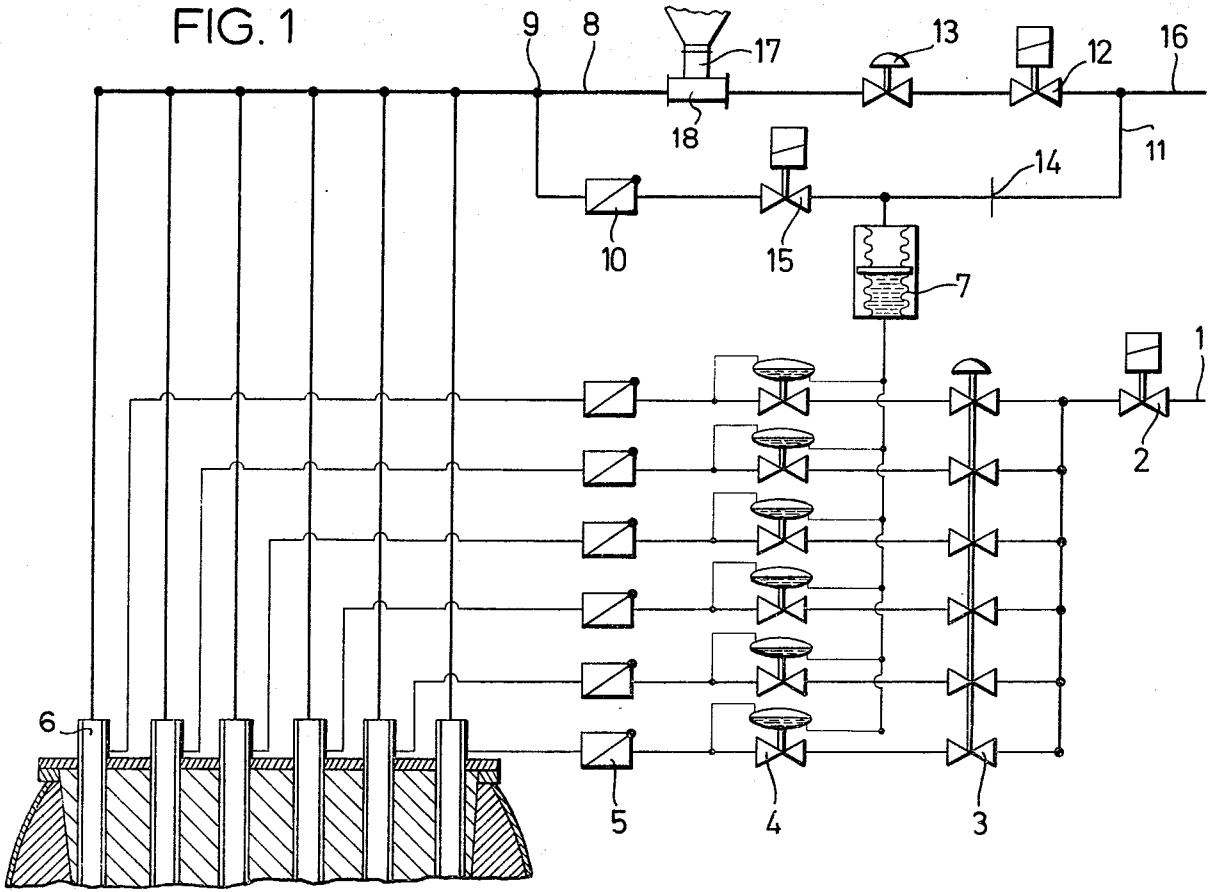
FIG. 1 is a schematic circuit diagram showing the controls of the invention.

Referring first to FIG. 1, a shut-off valve 2 is shown located in a main supply line 1 for the protective medium which may be gaseous or liquid hydrocarbons. The protective media flow through main supply line 1 at a pressure of about 8 atmospheres gauge as far as the parallel control valves 3 all of which are adjusted by a single activator. All of the control valves 3 will be set for the same flow cross-sections, so that the same amounts of protective medium will be supplied to all six tuyeres 6 shown mounted in the refractory masonry of a refining vessel The pressure of the protective medium will be reduced in control valves 3, for instance down to 1-6 atm. gauge, preferably 3 atm. gauge, because the pressure loss at the tuyere orifices will be about 1-2 atm. gauge and approximately 1 atm. gauge will be required for overcoming the ferrostatic pressure of the charge to be refined in the refining vessel.

A pressure-reducing valve 4 and a back-pressure valve 5 are mounted between each control valve and the tuyere to which it is connected. Pressure reducing valves 4 are individually controlled by a pressure transmitter 7 in communication with the pressure in main refining gas supply line 8, 16. In order to achieve this, a by-pass line 11 branches off main refining gas supply line 16 and returns to the main refining gas supply line at 9. A back pressure or check valve 10, an orifice plate 14, a pressure transmitter 7 and a shut-off valve 15 are mounted in or connected to by-pass line 11. A shut-off valve 12, a refining gas regulator valve 13 and a lime meter 17 are mounted in series in the part of refining gas supply line 16 which is connected in parallel to the by-pass line 11.

A check valve 10 located in by-pass line 11 prevents back-flowing of the refining gas or of the oxygen loaded with lime dust by lime feeder 17. When valve 15 is open, a slight amount of refining gas flows from main supply line 16, flows through by pass line 11 in an amount determined by the aperture of orifice plate or diaphragm 14. Pressure fluctuations at input location 9 are transmitted via pressure transmitter 7 to the pressure-reducing valves 4 in the supply lines of the protective medium, but will only be slightly affected by the flow rate of the refining gas passing through by-pass line 11. Therefore any kind of pressure fluctuation at input location 9 will promptly activate pressure-reducing valves 4 and therefore effect a corresponding pressure alteration in the protective medium.

If the valve 15 in the by-pass line is closed, the full refining gas pressure will be applied to pressure transmitter 7 and the pressure-reducing valves 4 will be fully opened. This condition will occur if large rates of protective medium are desired for relative low rates of refining gas, for example when tuyeres 6 are to be operated as burners in order to heat a refining vessal with new masonry or in order to pre-heat cold charge in the refining vessel.

Figure 3:
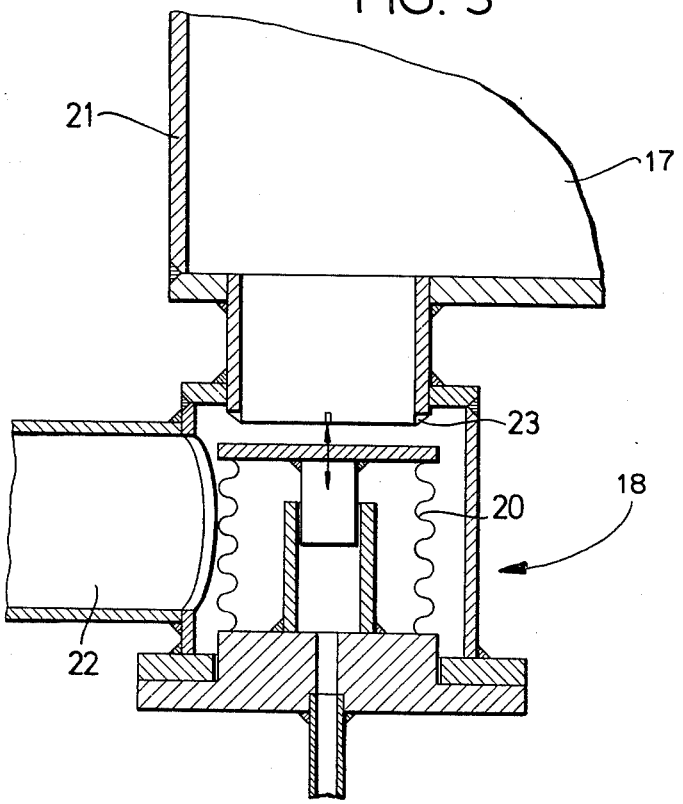
FIG. 3 is a view partly in section through a rate valve for controlled feeding of a suspension of oxygen and lime dust.

Valve 15 is always open during refining, since otherwise there would be danger of overflowing of the protective medium into the oxygen supply line in case of disturbances at the tuyere orifice. The pressure-reducing valves 4 are fully open when valve 15 is closed, but otherwise are out of operation. However, to prevent overflowing of the pretective medium into the oxygen supply line also when shut-off valve 15 is closed, a rate valve 18 shown in FIG. 3 and comprising a control-plate 20 limiting the cross-section is arranged downstream of the lime distributor 21 (FIG. 3). This control plate faces outlet aperture 23 of the lime distributor 21 and may be moved with respect to outlet aperture 23. During refining, control plate 20 will be in its lowest position, making the full aperture cross-section available for the refining gas or the suspension to flow into supply line 22 to the individual tuyeres. If however, main valve 15 in by-pass 11 is closed and the tuyeres are operated with lime-free oxygen as burners, the control plate will be moved in direction of the outlet orifice 23. In this manner, the oxygen rate may be widely reduced while maintaining the full oxygen pressure in the lime distributor 21 at 15 atm. gauge, for instance. If now due to disorders at the tuyere orifice there no longer will be any oxygen issuing therefrom, full oxygen pressure will very rapidly build up in the tuyere and overflowing of the protective medium will be prevented because its pressure will remain substantially less than the pressure of the oxygen.

Figure 2:
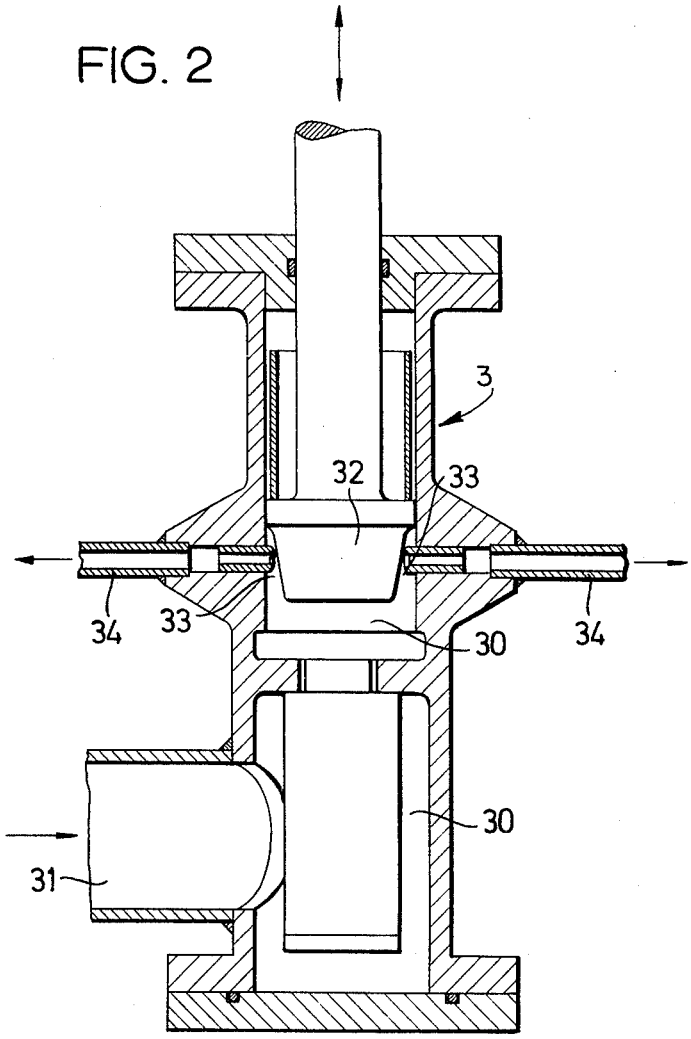
FIG. 2 is a view partly in section through a control valve for operating several tuyeres.

In lieu of several parallel control valves 3, shut-off valve 2 in the main protective medium supply line 1 may be followed by a single control valve provided with a number of outlets corresponding to the number of tuyeres. FIG. 2 shows such a control valve provided with an inlet pipe 31 issuing into a chamber 30 and with an axially movable control cone 32 which may be moved within the region of several outlets 34 to the tuyeres, which region lies in the plane of inlet apertures 33. The protective medium is at full pressure inside the control valve, for example 8 atmospheres gauge when propane is the protective medium. The axial motion of control cone 32 varies the opening of each tuyere inlet and controls the rate of flow of the protective medium supplied to the tuyeres.

It is also possible to use several control valves in lieu of the one control valve for all tuyeres shown in FIG. 2, each of said valves time controlling the rates of the protective medium to be supplied to a given group of tuyeres. The control valves may be provided with a common or else a separate, motorized, pneumatic or hydraulic motion drive.

Furthermore, instead of only two pipes, each of the tuyeres may consist of more than two concentric pipes and whereby several concentric annular spaces will be provided for the protective medium. In such a case the annular spaces of each individual tuyere may be connected to a common supply line for the protective medium and may be connected to the control of the invention.

The apparatus of the present invention will prevent overflowing and hence premature failure of individual tuyeres; therefore the life of the tuyeres will be the same as the life of the surrounding masonry. In some cases and in conjunction with other measures, this may result in the durability of a convertor bottom provided with dual or multiple pipe tuyeres corresponding to the durability of the remaining refractory lining and hence changing the bottom during a convertor campaign will no longer be required and the tuyeres and bottom will exhibit the same service life.

We claim:

1. In an apparatus for supplying a refining gas and for supplying a fluid protective medium individually to each of a plurality of tuyeres mounted in the refractory masonry of a refining vessel each of said tuyeres consisting of at least two concentric pipes with separate supply lines to supply said refining gas and to supply said protective medium, the refining gas passing through the center pipe and the protective medium passing through the annular spaces between said concentric pipes; and including a control valve (3) in the supply lines (1) through which said protective medium is supplied to each of said tuyeres, a pressure reducing valve (4) in each of said supply lines in series with said control valve (3), and a back pressure valve (5) between each of said tuyeres and each of said pressure reducing valves in each supply line of said protective medium, and the improvements which comprise: means to control each of said pressure reducing valves (4) said means comprising a pressure transmitter (7) operatively connected to a by-pass line (11) of said main refining gas supply line (16) and said pressure transmitter (7) transmitting the pressure fluctuations of the refining gas line to each of the pressure reducing valves (4) mounted in each of said protective medium lines, whereby the pressure of said protective medium flowing to said tuyeres is individually controlled and changed by the pressure reducing valves (4) in relation to the refining gas pressure in such a way that the pressure in each of said protective medium lines cannot exceed the pressure in the refining gas line.

2. Apparatus as defined in claim 1 including a single means for controlling all of the control valves (3).

3. Apparatus as defined in claim 1 including in addition a shut-off valve (2) mounted upstream of the control valves (3).

4. Apparatus as defined in claim 1 wherein said by-pass line (11) branches off before a lime feeder (17) in the main refining gas supply line (16) and issues into the main refining gas supply line (8, 16) behind line feeder (17).

5. Apparatus as defined by claim 1 including in addition a diaphragm (14) located upstream of said pressure transmitter (7) and a shut-off valve (15) and a back-pressure valve (10) mounted downstream of said pressure transmitter.

6. Apparatus as defined in claim 1 including in addition a shut-off valve (12) and a control valve (13) mounted in the main refining gas supply line (8).

7. Apparatus as defined in claim 1 including in addition a rate valve (20, 21, 22, 23) which is mounted immediately behind a lime feeder 17 connected to the main refining gas line.

8. Apparatus as defined in claim 7 wherein the rate valve is provided with a movable control plate (20) located opposite the outlet aperture (23) of a hopper (21) associated with lime feeder (17).

9. Apparatus as defined by claim 1 wherein said control valve (3) is provided with several outlets (34) each outlet leading to a tuyere annular space.

10. Apparatus as defined by claim 10 wherein said outlets (34) lie in a plane and in that their inlet orifices (33) are located in a chamber (30) with an axially movable control cone (32).

11. An apparatus as defined in claim 1 including means for setting the control valves (3) to permit transmission of the protective medium at speed of sound when said valves (3) are in their open position.

* * * * *